US008028740B2

(12) United States Patent
Otsuka et al.

(10) Patent No.: US 8,028,740 B2
(45) Date of Patent: Oct. 4, 2011

(54) TWIN ROLL CASTER

(75) Inventors: Hiroyuki Otsuka, Koto-ku (JP); Hiroki Yoshizawa, Koto-ku (JP); Shiro Osada, Koto-ku (JP); Hisahiko Fukase, Koto-ku (JP)

(73) Assignee: IHI Corporation, Tokyo (JP)

( * ) Notice: Subject to any disclaimer, the term of this patent is extended or adjusted under 35 U.S.C. 154(b) by 327 days.

(21) Appl. No.: 12/373,061

(22) PCT Filed: Jul. 27, 2006

(86) PCT No.: PCT/JP2006/314843

§ 371 (c)(1),
(2), (4) Date: Jan. 9, 2009

(87) PCT Pub. No.: WO2008/012888

PCT Pub. Date: Jan. 31, 2008

(65) Prior Publication Data

US 2009/0255644 A1 Oct. 15, 2009

(51) Int. Cl.
*B22D 11/06* (2006.01)

(52) U.S. Cl. ..... 164/428; 164/480

(58) Field of Classification Search ..... 164/428, 164/480

See application file for complete search history.

(56) References Cited

U.S. PATENT DOCUMENTS 4,883,113 A * 11/1989 Matsui et al. ..... 164/428

FOREIGN PATENT DOCUMENTS

JP 62 045456 2/1987
JP 1 224145 9/1989

OTHER PUBLICATIONS

U.S. Appl. No. 12/663,448, filed Dec. 7, 2009, Otsuka, et al.

* cited by examiner

*Primary Examiner* — Kuang Lin
(74) *Attorney, Agent, or Firm* — Oblon, Spivak, McClelland, Maier & Neustadt, L.L.P.

(57) ABSTRACT

A twin roll caster including chilled rolls, side weirs, and a molten-metal delivery nozzle. Baffles, contiguous with bottoms of end faces of the nozzle, project in a casting pool toward the side weirs to suppress stream of the molten metal into a nip between the rolls. Thus, hot molten metal just after poured into the pool does not instantly reach the nip along the side weirs, and molten metal decreases in temperature with lapse of time after the pouring streams into the nip as the rolls are rotated. As a result, belated formation of solidified shells at and adjacent to outer circumferential edges of the chilled rolls is eliminated. Thus, a strip delivered from the nip between the rolls has no reduced thickness at regions adjacent to lateral edges of the strip and has uniform thickness throughout the width of the strip.

14 Claims, 5 Drawing Sheets

TWIN ROLL CASTER

TECHNICAL FIELD

The present invention relates to a twin roll caster.

BACKGROUND ART

Known as one of techniques for directly producing a strip from molten metal is twin-roll continuous casting where molten metal is supplied to between a pair of rotated rolls to deliver a solidified metal strip therefrom.

FIG. 1 shows a convention twin roll caster comprising a pair of chilled rolls 1 arranged horizontally side by side and a pair of side weirs 2 associated with the rolls 1.

The chilled rolls 1 are constructed such that cooling water passes through the rolls and a nip G between the rolls may be expanded/contracted depending on thickness of the strip 3 to be produced.

The rotated speed and direction of the chilled rolls 1 are set such that outer circumferential surfaces of the respective rolls move from above to the nip G between the rolls at the same speed.

One of the side weirs 2 surface-contact one ends of the respective chilled rolls 1 and the other side weir 2, the other ends of the rolls 1. In a space defined by the chilled rolls 1 and the side weirs 2, a molten-metal delivery nozzle 4 made from refractory material is arranged just above the nip G between the rolls.

The delivery nozzle 4 has a top with an elongated nozzle trough 6 for receiving molten metal 5 and has longitudinal side walls formed with openings 7 from the trough 6 toward the outer circumferential surfaces of the chilled rolls 1, the openings 7 being formed on the side walls adjacent to lower ends thereof and being aligned along axes of the rolls 1. When the molten metal is poured into the nozzle trough 6, a casting pool 8 is formed above the nip G between the rolls 1 and in contact with the outer circumferential surfaces of the rolls 1.

Thus, with the casting pool 8 being formed, the rolls 1 are rotated while being cooled by circulation of cooling water, so that the molten metal 5 is solidified on the outer circumferential surfaces of the rolls 1 to deliver a strip 3 downwardly from the nip G.

In so-called triple point regions where the rolls 1, the side weirs 2 and the casting pool 8 meet, the solidified shells may be produced abnormally.

If such solidified shells at the triple point regions were drawn and peeled away by the solidified shells on the outer circumferential surfaces of the rolls 1, they might be drawn into the nip G between the rolls 1, resulting in not only defective shape in the form of locally thickened strip 3, but also deteriorated cooling efficiency due to the flared nip G by the locally thickened strip, breakage of the strip 3 due to thermal recuperation from the molten metal 5 and/or impair of the side weirs 2 upon drop of the solidified shells.

Thus, a twin roll caster has been proposed which directs molten metal 5 to side weirs 2 and especially positively in a direction tangent to chilled rolls 1 so as to suppress formation of undesired solidified shell (see, for example, Patent Literature 1).

[Patent Literature 1] JP62-45456A

SUMMARY OF INVENTION

Technical Problems

However, in the twin roll caster according to the Patent Literature 1, the hot molten metal 5 just after the pouring streams along the side weirs 2 to reach the nip G within an extremely short time, so that the solidified shells are produced belatedly at regions adjacent to edges of the outer circumferential surfaces of the chilled rolls 1.

As a result, the strip 3 delivered from the nip G tends to have reduced thickness at its lateral ends or edges, resulting in difficulty of having uniform thickness throughout the width of the strip 3.

The invention was made in view of the above and has its object to provide a twin roll caster which can suppress reduction in thickness of a strip at lateral edges thereof.

Solution to Problems

In order to attain the above object, the invention is directed to a twin roll caster with chilled rolls, side weirs and a molten-metal delivery nozzle, comprising baffles capable of suppressing stream of molten metal along the side weirs into a nip between the rolls.

More specifically, the baffles are projected from bottoms of end faces of the nozzle in a casting pool toward the side weirs, respectively; alternatively, the baffles are projected from the side weirs in the casting pool toward the bottoms of the end faces of the nozzle, respectively.

Alternatively, ends of the nozzle extend to the side weirs, respectively, the baffles being projected from intermediate portions on a bottom of the nozzle toward said side weirs so as to form voids between the baffles and the bottom of the nozzle, respectively.

According to the invention, in order that the hot molten metal just after the pouring does not stream along the side weirs to instantly reach the nip, the baffles suppress stream of the molten metal toward the nip to eliminate belated formation of the solidified shells at and adjacent to the edges of the outer circumferential surfaces of the chilled rolls.

Extension of the ends of the nozzle to the side weirs prevents the hot molten metal from being poured directly into just above the nip at regions adjacent to the side weirs and reduces a contact area of the molten metal to the side weirs.

Advantageous Effects of Invention

A twin roll caster according to the invention exhibits excellent effects and advantages mentioned below.

(1) The baffles suppress stream of the molten metal toward the nip and eliminate belated formation of the solidified shells at and adjacent to the edges of the outer circumferential surfaces of the chilled rolls, so that the strip delivered from the nip between the rolls has no reduced thickness at regions adjacent to lateral edges of the strip and the strip can be obtained which has uniform thickness throughout the width of the strip.

(2) Extension of the ends of the nozzle to the side weirs prevents the molten metal from being poured into just above the nip between rolls at regions adjacent to the side weirs and eliminates belated formation of the solidified shells at and adjacent to the edges of the outer circumferential surfaces of the chilled rolls, so that the strip delivered from the nip between the rolls has no reduced thickness at regions adjacent to lateral edges of the strip and the strip can be obtained which has uniform thickness throughout the width of the strip.

(3) Extension of the ends of the nozzle to the side weirs reduces the contact area of the molten metal to the side weirs, which suppresses formation of undesired solidified shell.

REFERENCE SIGNS LIST

Figure 1:
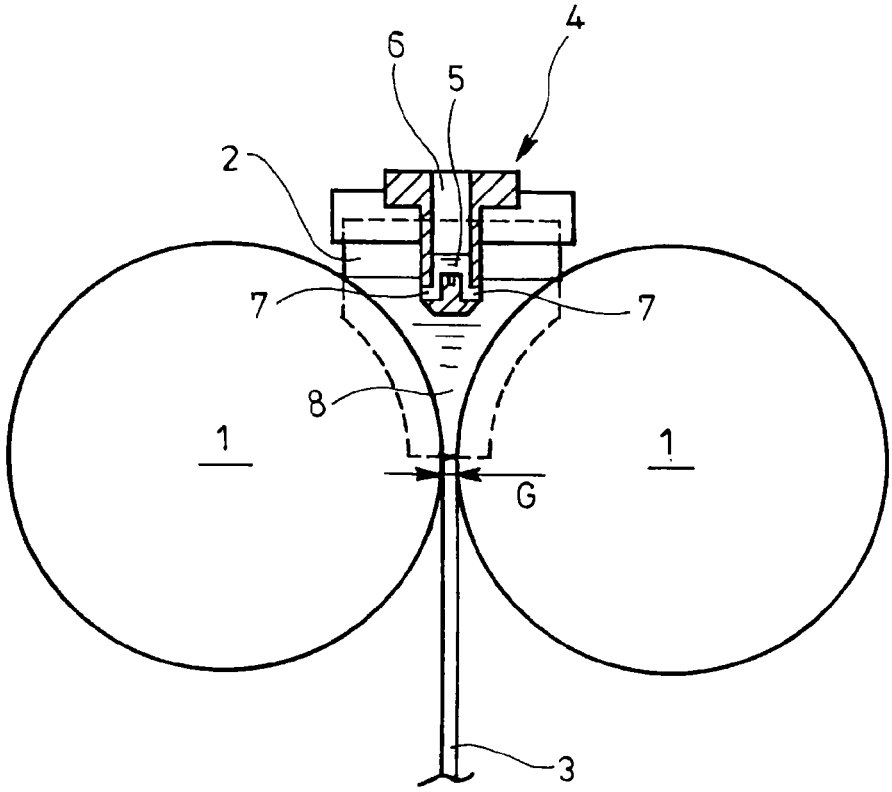
FIG. 1 is a schematic view showing a conventional twin roll caster looking in a direction of axes of chilled rolls.

1 chilled roll
2 side weir
4 molten-metal delivery nozzle
8 casting pool
11 baffle
12 void
13 baffle
G nip
S stream

DESCRIPTION OF EMBODIMENTS

Embodiments of the invention will be described in conjunction with the drawings.

Figure 2:
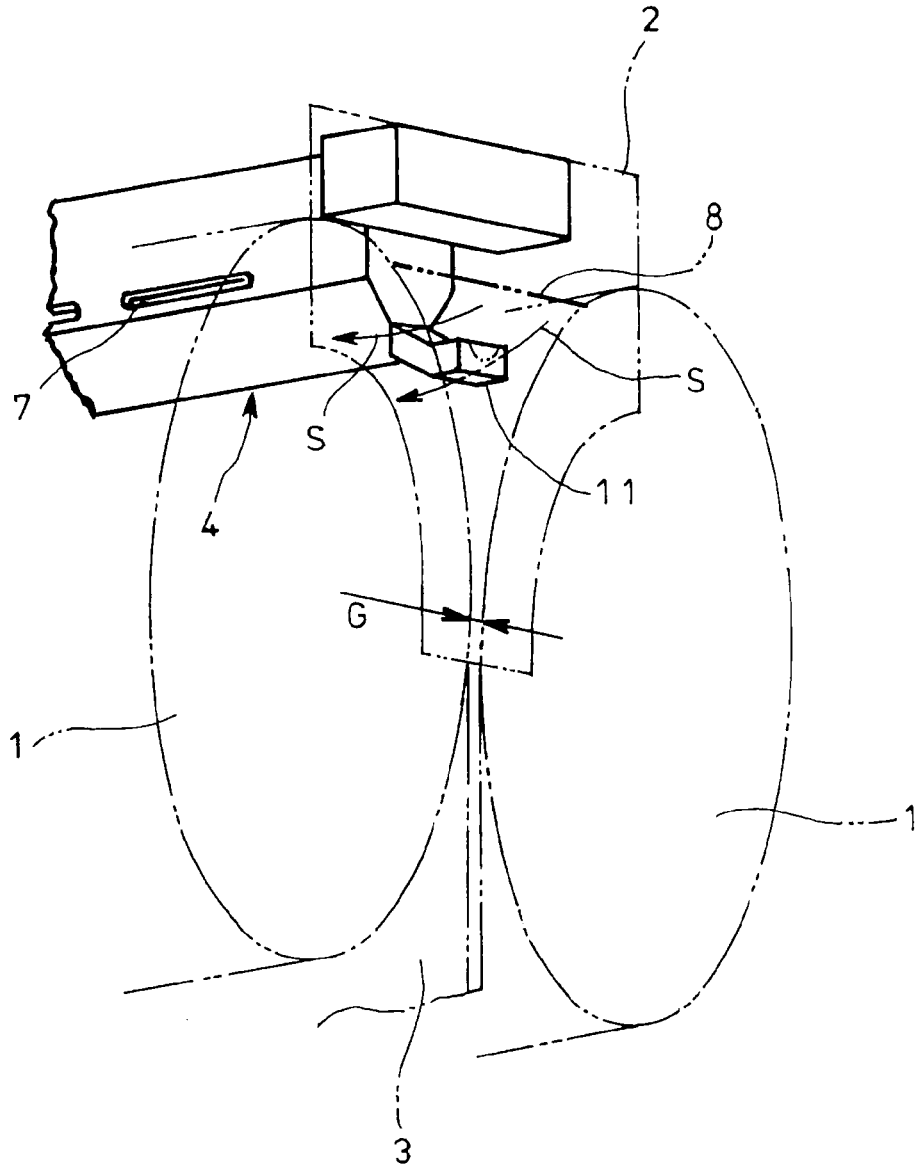
FIG. 2 is a partial perspective view showing a first embodiment of the twin roll caster according to the invention.
Figure 3:
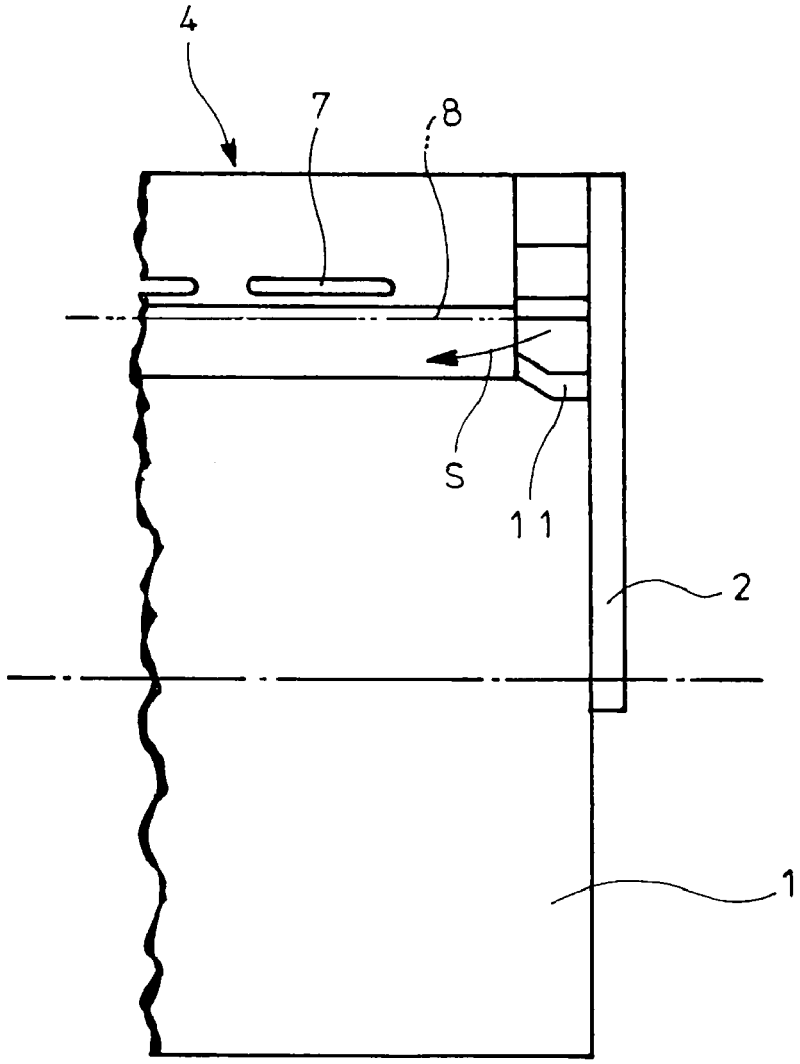
FIG. 3 is a schematic view showing the twin roll caster of FIG. 2 looking radially of the chilled roll.

FIGS. 2 and 3 show a first embodiment of a twin roll caster according to the invention in which parts similar to those in FIG. 1 are represented by the same reference numerals.

In a twin roll caster with chilled rolls 1, side weirs 2 and a molten-metal delivery nozzle 4, baffles 11 are provided which are contiguous with bottoms of end faces of the delivery nozzle 4 and are projected in a casting pool 8 toward the side weirs 2.

Tip ends of the baffles 11 may abut on the side weirs 2 or may be spaced apart from the side weirs 2 by minimum gaps, the baffles 11 being also spaced apart from the outer circumferential surfaces of the chilled rolls 1 by minimum gaps.

In the twin roll caster, the baffles 11 suppress stream S of the molten metal just adjacent to the side weirs 2 directly into the nip G between the rolls and guide the same in less resistive directions, i.e., toward longitudinally intermediate portions of the chilled rolls 1, so that the hot molten metal just after the pouring does not reach the nip G along the side weirs 2; the molten metal considerably lowered in temperature with lapse of time after the pouring is guided into the nip G between the rolls 1 with the rotation of the rolls.

Thus, eliminated is the belated formation of the solidified shells at and adjacent to the edges of the outer circumferential surfaces of the chilled rolls adjacent to the side weirs 2; as a result, the strip 3 delivered from the nip G between the rolls has no reduced thickness at regions adjacent to lateral edges of the strip and the strip 3 can be obtained which has uniform thickness throughout the width of the strip.

The baffle 11 may be contiguous with the side weirs 2 to be projected in the casting pool 8 toward the bottoms of the end faces of the delivery nozzle 4. When the baffle 11 is grooved at its top into gutter shape as shown in two-dotted chain line in FIG. 2, it may be expected that the stream S of the molten metal in the groove is redirected upward.

Figure 4:
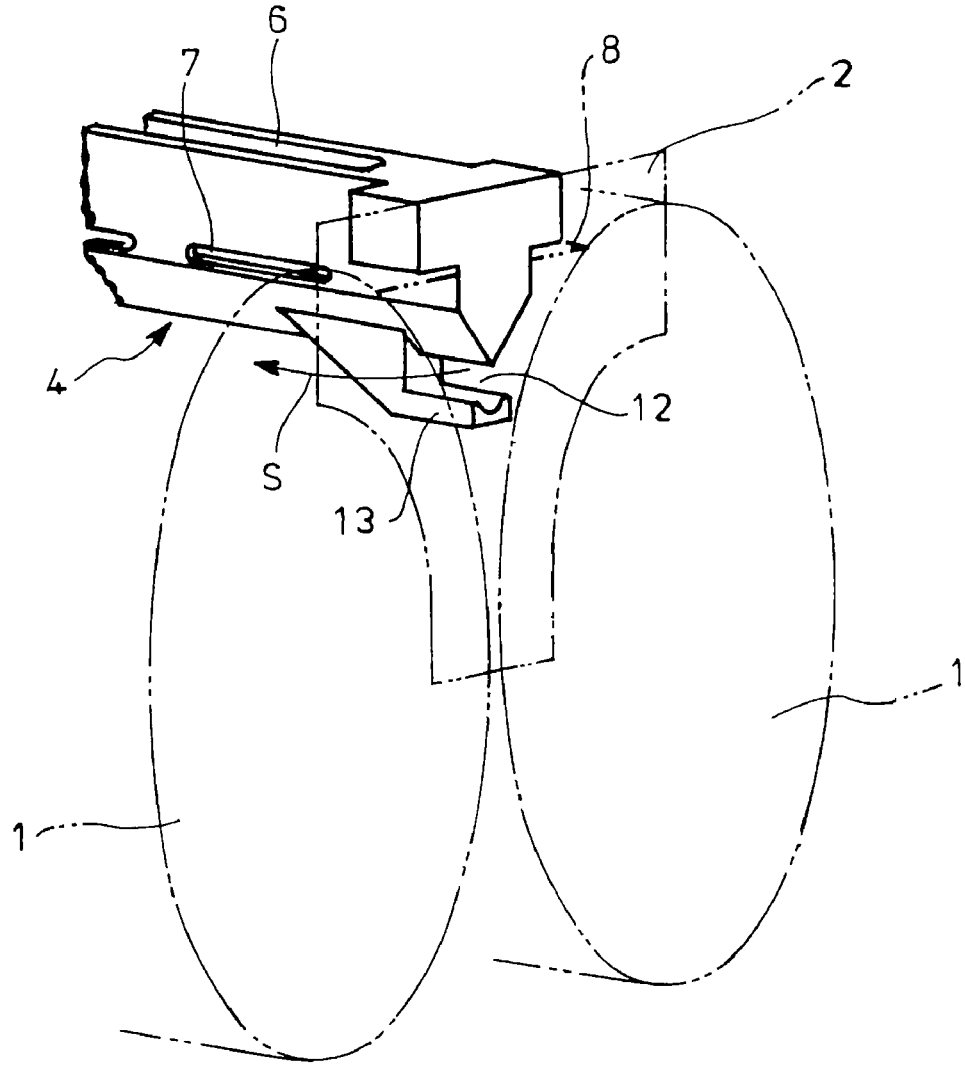
FIG. 4 is a partial perspective view showing a second embodiment of the twin roll caster according to the invention.
Figure 5:
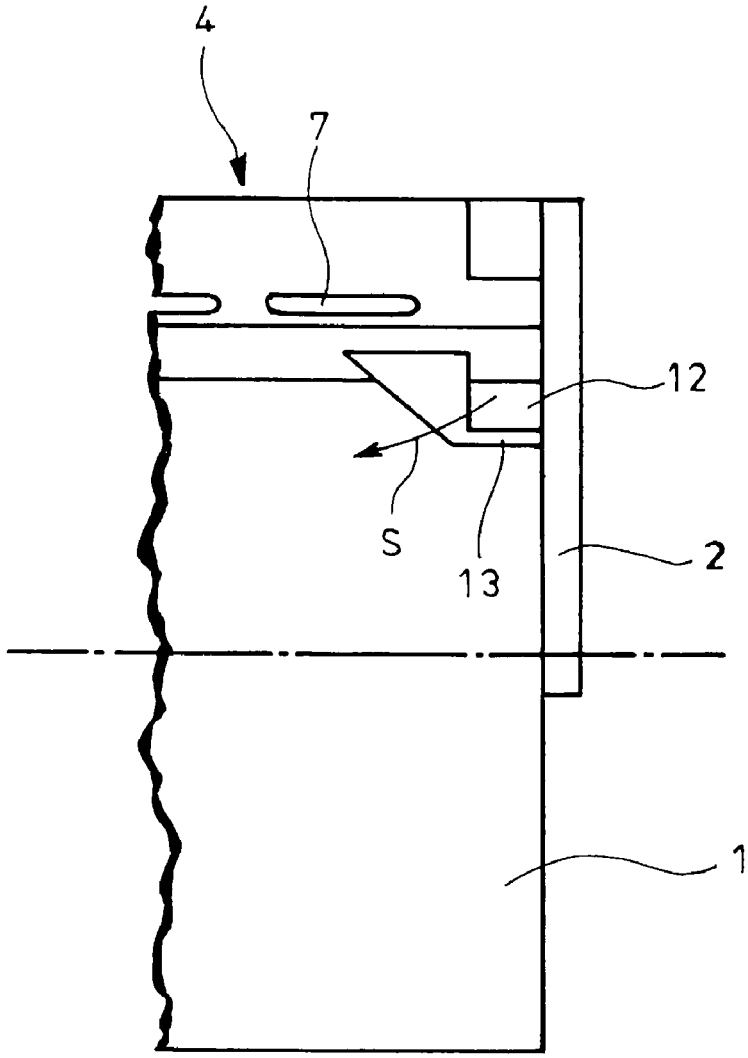
FIG. 5 is a schematic view showing the twin roll caster of FIG. 4 looking radially of the chilled rolls.

FIGS. 4 and 5 show a second embodiment of a twin roll caster according to the invention in which parts similar to those in FIG. 1 are represented by the same reference numerals.

In a twin roll caster with chilled rolls 1, side weirs 2 and a molten-metal delivery nozzle 4, ends of the delivery nozzle 4 extend to side weirs 2, respectively, guttered baffles 13 being projected from intermediate portions on a bottom of the nozzle 4 toward the side weirs 2 to form voids 12 between the baffles and the bottom of the nozzle, respectively.

Tip ends of the baffles 13 may abut on the side weirs 2 or may be spaced apart from the side weirs 2 by minimum gaps, the baffles 13 being also spaced apart from the outer circumferential surfaces of the chilled rolls 1 by minimum gaps.

In the twin roll caster, the ends of the nozzle 4 extend to the side weirs 2, which prevents the molten metal from being directly poured into just above the nip G just adjacent to the side weirs. It reduces the contact area of the molten metal to the side weirs 2, which can suppress formation of undesired solidified shell.

The steam S of the molten metal from the voids 12 adjacent to the side weirs 2 to outside is prevented by the baffle 13 from being directly directed to the nip G between the rolls, and is guided in less resistive directions, i.e., toward longitudinally intermediate portions of the chilled rolls 1, so that the molten metal lowered in temperature with lapse of time after the pouring is guided into the nip G between the rolls with the rotation of the rolls 1.

The steam S of the molten metal introduced into the gutter on the baffles 13 is partly redirected upward.

Thus, eliminated is the belated formation of the solidified shells at and adjacent to the edges of the outer circumferential surfaces of the chilled rolls 1 adjacent to the side weirs 2; as a result, the strip 3 delivered from the nip G between the rolls has no reduced thickness at regions adjacent to lateral edges of the strip and the strip 3 can be obtained which has uniform thickness throughout the width of the strip.

Alternatively, the baffles 13 contiguous with the side weirs 2 may be projected in the casting pool 8 toward the bottom end faces of the molten-metal delivery nozzle 4; the tops of the baffles 13 may not always be grooved.

It is to be understood that a twin roll caster according to the invention is not limited to the above embodiments and that various changes and modifications may be made without departing from the scope of the invention.

INDUSTRIAL APPLICABILITY

A twin roll caster according to the invention is applicable for production of steel and other various strips.

The invention claimed is:

1. A twin roll caster comprising:

a pair of parallel chilled casting rolls forming a nip between them;

a molten metal delivery nozzle to deliver molten metal into the nip so as to form a casting pool of molten metal supported on the casting rolls above the nip;

a pair of pool confining side weirs at ends of the casting rolls, voids being located between bottoms of end faces of the delivery nozzle and the side weirs; and baffles located in the voids to suppress flow of molten metal in the casting pool downwardly through the voids closely adjacent the side weirs directly into the nip between the casting rolls, the baffles being gutter shaped.

2. The twin roll caster as claimed in claim 1, wherein the baffles are projected from bottoms of end faces of the nozzle in a casting pool toward the side weirs, respectively.

3. The twin roll caster as claimed in claim 1, wherein the baffles are projected from the side weirs in a casting pool toward bottoms of end faces of the nozzle, respectively.

4. The twin roll caster as claimed in claim 1, wherein ends of the nozzle extend to the side weirs, respectively, the baffles being projected from a central portion on a bottom of the nozzle toward said side weirs to form voids between the baffles and the bottom of the nozzle, respectively.

5. The twin roll caster as claimed in claim 1, wherein ends of the nozzle extend to the side weirs, respectively, the baffles being projected from said side weirs toward a central portion on a bottom of the nozzle, respectively, to form voids between the baffles and the bottom of the nozzle, respectively.

6. The twin roll caster as claimed in claim 1, wherein the baffles abut on the side weirs, respectively.

7. The twin roll caster as claimed in claim 2, wherein the baffles abut on the side weirs, respectively.

8. The twin roll caster as claimed in claim 4, wherein the baffles abut on the side weirs, respectively.

9. The twin roll caster as claimed in claim 1, wherein the baffles abut on the nozzle.

10. The twin roll caster as claimed in claim 3, wherein the baffles abut on the nozzle.

11. The twin roll caster as claimed in claim 5, wherein the baffles abut on the nozzle.

12. The twin roll caster as claimed in claim 1, wherein the molten metal delivery nozzle has an elongated nozzle trough for receiving molten metal with side walls formed with openings in lower parts of the side walls for generally horizontal outflow of molten metal from the trough toward outer circumferential surfaces of the casting rolls.

13. The twin roll caster as claimed in claim 1, wherein each baffle has a groove running down the baffle toward the side weir.

14. The twin roll caster as claimed in claim 1, wherein the baffles with a gutter shape redirect upward molten metal poured down onto the baffles.

* * * * *